US007727011B2

(12) United States Patent
Montena et al.

(10) Patent No.: US 7,727,011 B2
(45) Date of Patent: Jun. 1, 2010

(54) COAX CONNECTOR HAVING CLUTCHING MECHANISM

(75) Inventors: Noah Montena, Syracuse, NY (US); David Jackson, Manlius, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 34 days.

(21) Appl. No.: 11/113,504

(22) Filed: Apr. 25, 2005

(65) Prior Publication Data

US 2006/0240709 A1 Oct. 26, 2006

(51) Int. Cl.
*H01R 9/05* (2006.01)

(52) U.S. Cl. ..... 439/578; 439/584

(58) Field of Classification Search ..... 439/578, 439/583, 584, 320, 322
See application file for complete search history.

(56) References Cited

U.S. PATENT DOCUMENTS

| | | | | |
|---|---|---|---|---|
| 3,680,034 | A | 7/1972 | Weichien et al. | |
| 3,953,097 | A * | 4/1976 | Graham | 439/307 |
| 4,500,153 | A | 2/1985 | Mattingly, Jr. et al. | |
| 4,834,675 | A * | 5/1989 | Samchisen | 439/578 |
| 5,879,191 | A | 3/1999 | Burris | |
| 6,290,525 | B1 * | 9/2001 | Jacobi | 439/319 |
| 6,716,062 | B1 * | 4/2004 | Palinkas et al. | 439/578 |
| 6,769,926 | B1 * | 8/2004 | Montena | 439/253 |
| 6,817,896 | B2 * | 11/2004 | Derenthal | 439/578 |
| 6,848,920 | B2 * | 2/2005 | Fox | 439/133 |
| 6,971,912 | B2 * | 12/2005 | Montena et al. | 439/578 |
| 7,192,308 | B2 * | 3/2007 | Rodrigues et al. | 439/578 |
| 2005/0029807 | A1 | 2/2005 | Montena | |

FOREIGN PATENT DOCUMENTS

| | | | |
|---|---|---|---|
| AT | 308223 | B | 6/1973 |
| BE | 753046 | A1 | 12/1970 |
| CA | 928354 | A1 | 6/1973 |
| CH | 542527 | A | 9/1973 |
| DE | 2034948 | A1 | 2/1971 |
| DE | 2034948 | C3 | 2/1971 |
| DE | 3229129 | A1 | 8/1983 |
| FR | 2055241 | A5 | 5/1971 |
| FR | 2516314 | A1 | 5/1983 |
| GB | 1310404 | A | 3/1973 |
| GB | 2109645 | A | 6/1983 |
| IL | 34775 | A | 11/1972 |
| JP | 51024111 | B | 7/1976 |
| NL | 7010308 | A | 1/1971 |
| SE | 375652 | B | 4/1975 |

* cited by examiner

*Primary Examiner*—Xuong M Chung-Trans
(74) *Attorney, Agent, or Firm*—Hiscock & Barclay, LLP

(57) ABSTRACT

The invention is directed to a clutching mechanism for a coax connector. The device comprises an extended nut having a standard connector contained within. The extended nut comprises internal threads and a first clutch face and the internal standard connector comprises a connector body having a second clutch face. In operation, the first clutch face and the second clutch face are engaged by forcing the nut toward the connector body/cable, thereby serving as an interlocking mechanism. The device further comprises a compression sleeve between the nut and the connector body, serving to secure the cable to the connector.

12 Claims, 9 Drawing Sheets

COAX CONNECTOR HAVING CLUTCHING MECHANISM

FIELD OF THE INVENTION

This invention relates to connectors, and more particularly, to a connecting assembly that can be used in place of a conventional nut to connect a cable to an externally threaded connecting port.

BACKGROUND OF THE INVENTION

Numerous connecting assemblies are currently available for connecting a cable, such as a coaxial cable, to an externally threaded connecting port. Additionally, externally threaded connecting ports may be located either indoors or outdoors, and often vary considerably.

A commonly utilized assembly for connecting a cable to a port is a nut, aligned with, and rotated relative to, an externally threaded connecting port. This assembly configuration allows the installer to selectively secure the cable thereto and release the cable therefrom. Loosely connected cables are a common problem in connecting cables to ports. This problem persists outdoors on taps and splitters, as well as inside the home behind the TV. While a loose outdoor connection can create undesired broadcasting of the signal, or allow moisture to enter the cable to cause corrosion within the connection and the equipment, a loose indoor connection may allow electromagnetic interference of all types to degrade the signal, resulting in poor picture quality.

Whether indoors or outdoors, the aforementioned loose connections often require cable operators attention and visits to sites resulting from loose connections contribute substantially to a system's operating expense. Cable companies endeavor to teach various installation techniques to service professionals to assure the proper attachment of connectors. Such techniques typically include the use of a torque wrench, having a preset limit sufficient to ensure proper tightness. However, the use of a torque wrench may be inconvenient at the installation site, or simply foregone in the interest of time. As a result, the connectors may be inadequately tightened on the equipment ports. The typical technician is only able to achieve 2-5 in-lbs. of torque with fingers on a conventional 7/16 hex nut with the best of access. This is far below the recommended specification of 30 in-lbs., and sometimes not even enough to overcome thread roughness, thus leaving an actual gap between contacting surfaces of the port and connector.

Therefore, what is needed in the art is an apparatus and method for attaching a coax connector to a threaded port that requires no special tooling and allows the installer to generate more torque using only his hands thereby providing a better connection.

Additional what is needed in the art is an apparatus and method for attaching a cable to a connector that is relatively easy and requires no additional specialized tooling.

SUMMARY OF THE INVENTION

The invention is directed to a clutching mechanism for a coax connector. The device comprises an extended nut having a standard connector contained within. The extended nut comprises internal threads and a first clutch face and the internal standard connector comprises a connector body having a second clutch face. In operation, the first clutch face and the second clutch face are engaged by forcing the nut toward the connector body/cable, thereby serving as an interlocking mechanism. The device further comprises a compression sleeve between the nut and the connector body, serving to secure the cable to the connector. Additionally, a variety of nuts having various external gripping surfaces are disclosed.

A particular embodiment of the present invention comprises a coax connector having a clutching mechanism comprising a nut and a connector body wherein said nut defines an internal cavity, and said connector body is contained partially within said cavity; said nut further comprises internal threads and a first clutch face; and said connector body further comprises a connector body having a second clutch face wherein the first clutch face and the second clutch face may be engaged by forcing the nut toward the connector body/cable, thereby serving as an interlocking mechanism.

Additionally, the present invention is directed to a method of attaching a coax cable to a connector mechanism wherein said connector mechanism comprises a post, an extended nut, a connector body, an O-ring, and a compression sleeve, comprising the steps of: pushing a cable into the connector body thereby causing the connector body to engage the extended nut in a locked position; rotating the cable within the connector body to assure the cable is properly seated within the cable body; and advancing the compression sleeve toward the connector body thereby securing the cable to the connector mechanism.

An advantage of the present invention is that it provides an apparatus and method for attaching a coax connector to a threaded post that requires no special tooling and allows the installer to generate more torque using only his hands thereby providing a better connection.

An additional advantage of the present invention is that it provides an apparatus and method for attaching a cable to a connector that is relatively easy and requires no additional specialized tooling.

BRIEF DESCRIPTION OF THE DRAWINGS

The above-mentioned and other features and advantages of this invention, and the manner of attaining them, will become apparent and be more completely understood by reference to the following description of one embodiment of the invention when read in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
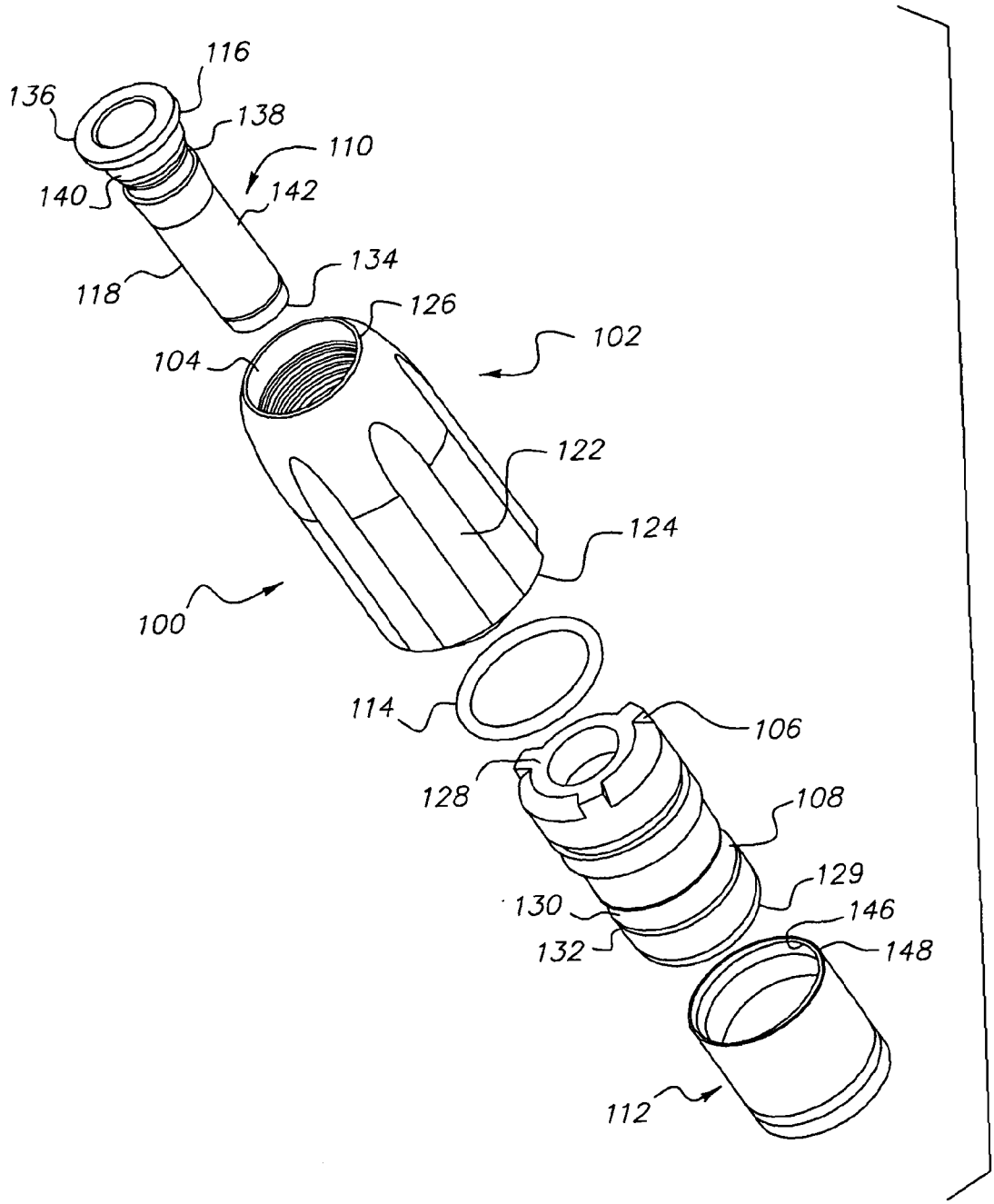
FIG. 1. is an exploded perspective view illustrating elements of a first embodiment of the Coax connector clutching mechanism of the present invention.

Referring to FIG. 1, a perspective view illustrating elements of a first embodiment of the Coax connector clutching mechanism 100 of the present invention is shown. The assembly comprises a post member 110, a nut body 102, an O-ring 114, a connector body 108, and a compression sleeve 112.

The post member comprises a base segment 116 and a stem segment 118. Additionally, the post member 110 comprises a substantially cylindrical bore 134 through its axial length adapted to receive a coaxial cable (not shown). The base segment 116 of the post member 110 further comprises flanged end 136 and annular groove 138 separated by substantially annular segment 140. As will be better understood in the description of FIG. 2, the post member is adapted to be received within the nut body 102 and connector body 108. Additionally the stem segment 118 comprises an elongated cylindrical bore 134 and an outer surface 142 for receiving and retaining the aforementioned a coaxial cable (not shown).

Figure 2:
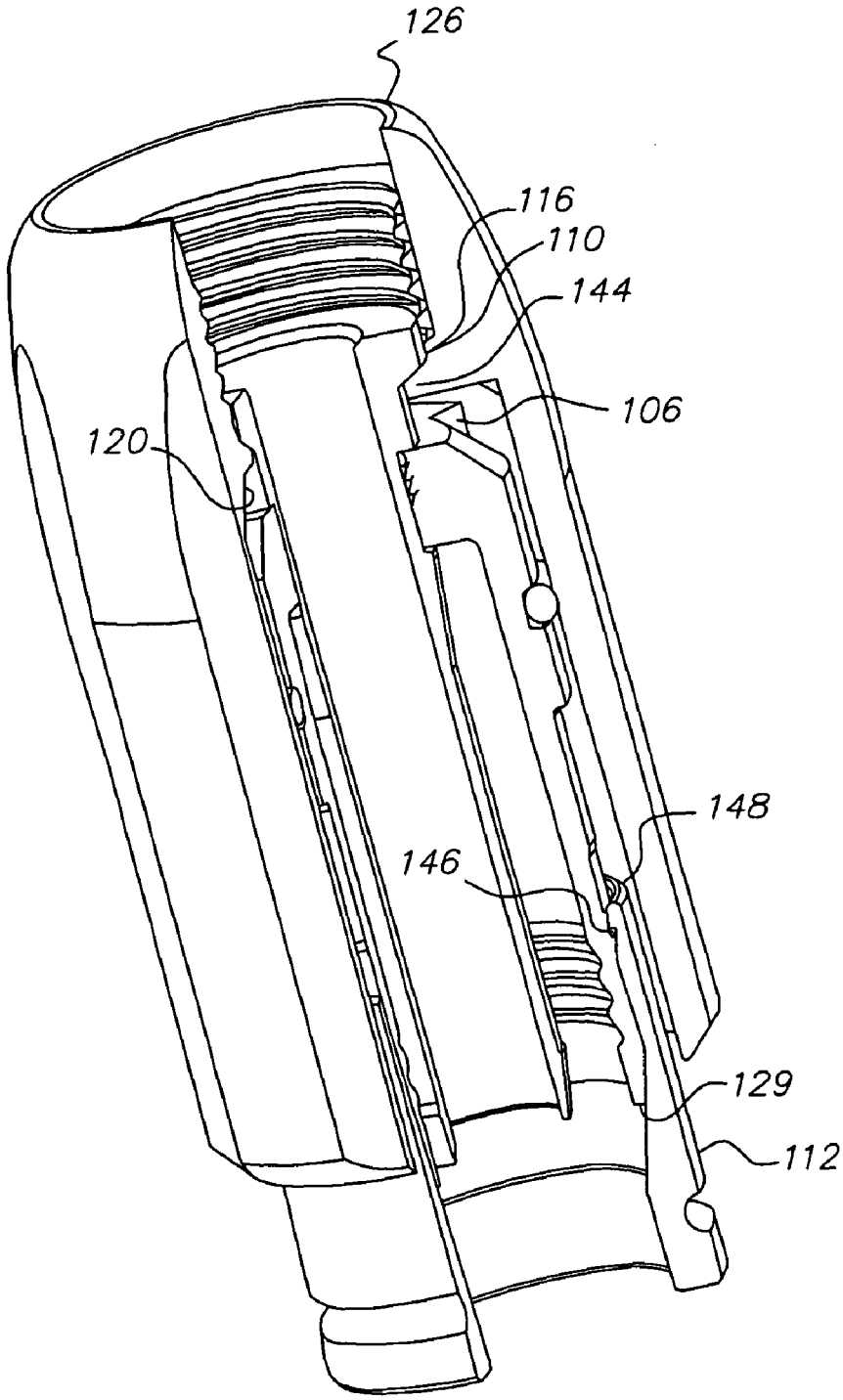
FIG. 2 is a perspective view of an assembled first embodiment according to the present invention with portions broken away.

Referring now to FIG. 2, the nut body 102 includes a first end 126 and a second end 124, wherein the inner surface of the first end comprises a threaded segment 104. The threaded segment 104 is adapted to be received by an externally threaded connector (not shown). Furthermore, the first end 126 is adapted to receive the post member 110, thereby permitting the post member 110 to rotate freely within said nut body 102. The nut body 102 further comprises an annular lip 144 adjacent to the threaded section which communicates with the flanged end 136 of the base 116 of the post member 110 when post member is within the nut body as illustrated in FIG. 2. As illustrated, the inner surface of the nut body 202 includes at least one internal clutch face 220 which will be discussed in greater detail in the following paragraphs.

Referring again to FIG. 1, the connector body 108 has a first end 128 wherein said first end further comprises a connector body clutch face 106. Additionally, the connector body comprises a second end 129, wherein the outer surface of the second end further comprises an annular groove 130 and annular ledge 132. The groove 130 and annular ledge 132 serve to receive an annular lip 146 protruding inward on a first end 148 of the compression sleeve 112.

Figure 3:
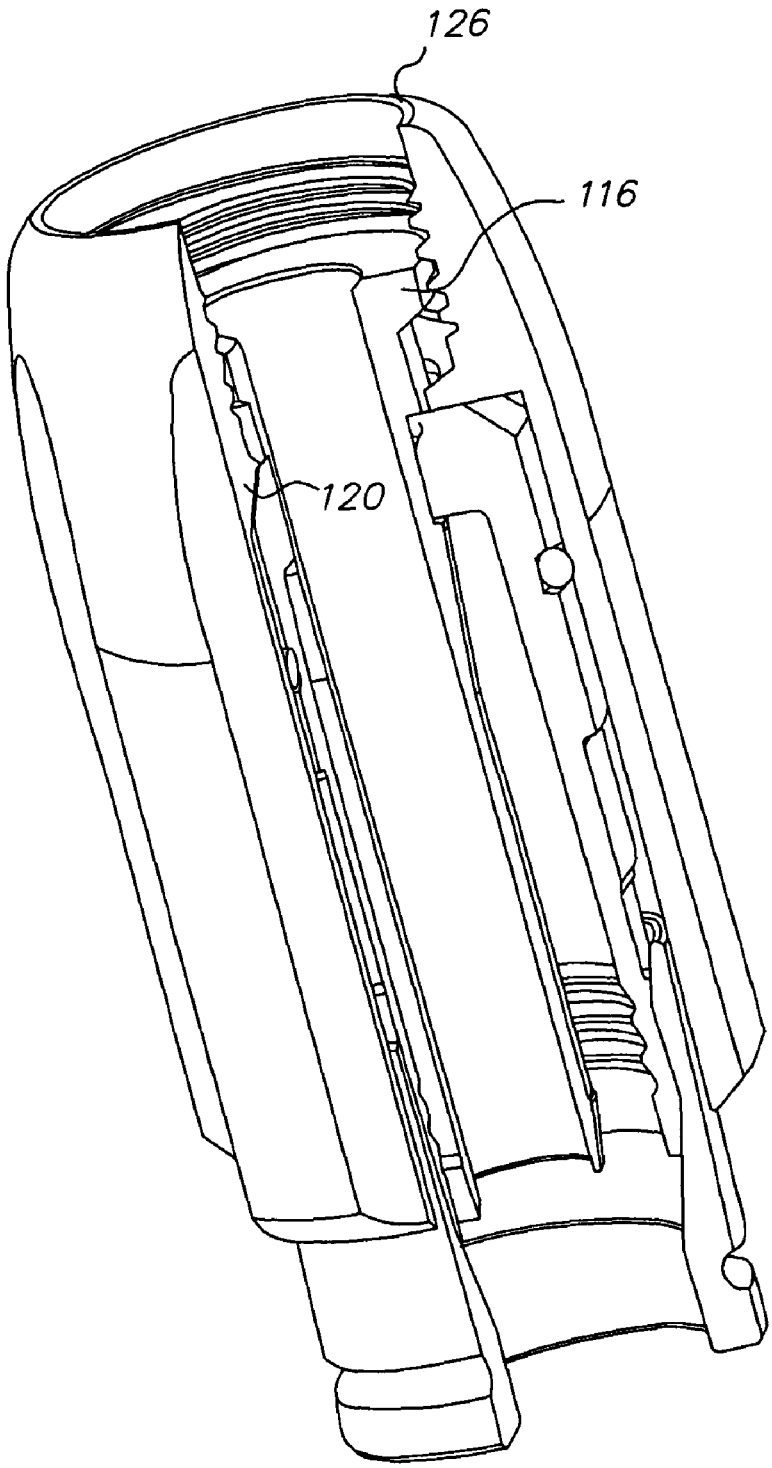
FIG. 3 is a perspective view of an assembled first embodiment according to the present invention with portions broken away.

Referring now to FIGS. 2 and 3, a view of the nut body in the "free' position with the connector body, and in the 'locked' position with the connector body are shown respectively. In operation, the clutch face 120 of the nut body 102 mates with a similar clutch face 106 of the connector body 108. The nut body 102 serves two functions. Upon installing the cable (not shown) on the connector body 108, the installer may hold the nut body 102 firmly with one hand, and push the cable in at the other end 129 of the connector body 108. The opposing forces of the cable being pushed and the installer's hand firmly holding the nut body 102, cause the clutch faces 106 and 120 to mechanically engage in a lock position as illustrated in FIG. 3. While the nut body 102 and connector body 108 are in the locked position, the installer may alternately rotate the prepared cable (not shown) clockwise and counter clockwise, thereby properly seating the cable in the connector body 108. With the cable seated in the connector body 108, compression sleeve 112 may now be advanced forward on the connector body, thereby securing the cable to the connector 100. Referring once again to FIGS. 1-3, the method of securing the compression sleeve 112 to the connector body 108 may be better understood. As described above, the clutch/connector body 108 comprises a second end 129, wherein the outer surface of the second end further comprises an annular groove 130 and annular ledge 132. The groove 130 and annular ledge 132 serve to receive an annular lip 146 protruding inward on a first end 148 of the compression sleeve 112.

With the connector assemble fully assembled, the installer may move the nut away from the connector body, thereby disengaging the clutch faces 106 and 120, to rotatably attach the nut body 102 to the interface port (not shown) without turning the cable. The extended length of the nut body 102 also provides a manageable surface for the installer to grasp and apply greater torque in tightening the nut body 102.

Referring now to FIGS. 4-7, an additional embodiment of the present invention is shown. The post member 210 of this embodiment 200 is substantially similar to the previous embodiment, comprising a base segment 216 and a stem segment 218. Additionally, the post member 210 comprises a substantially cylindrical bore 234 through its axial length adapted to receive a coaxial cable (not shown). The base segment 216 of the post member 210 further comprises flanged end 236 and annular groove 238 separated by substantially annular segment 240.

Figure 5:
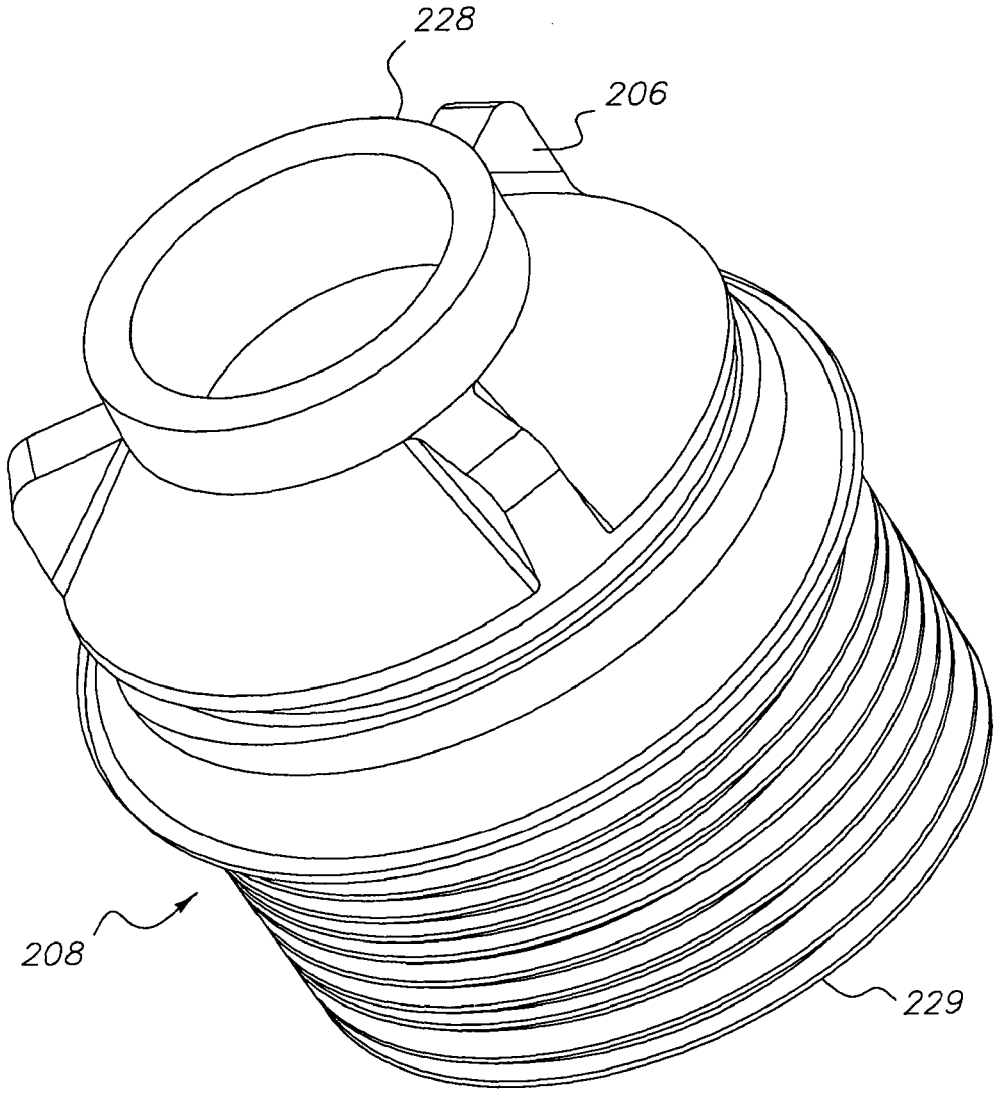
FIG. 5. is a perspective view illustrating the connector body of the second embodiment of the Coax connector clutching mechanism of the present invention.

Referring now to FIG. 5, the connector body 208 has a first end 228 wherein said first end further comprises at least one connector body clutch face 206. Additionally, the connector body 208 comprises a second end 229, wherein the outer surface of the second end further comprises an external threaded portion 230. As will be described in greater detail in the following paragraphs, the external threaded portion 230 of the connector body 208 is adapted to threadedly engage an internal threaded segment 252 of end nut 250.

Figure 4:
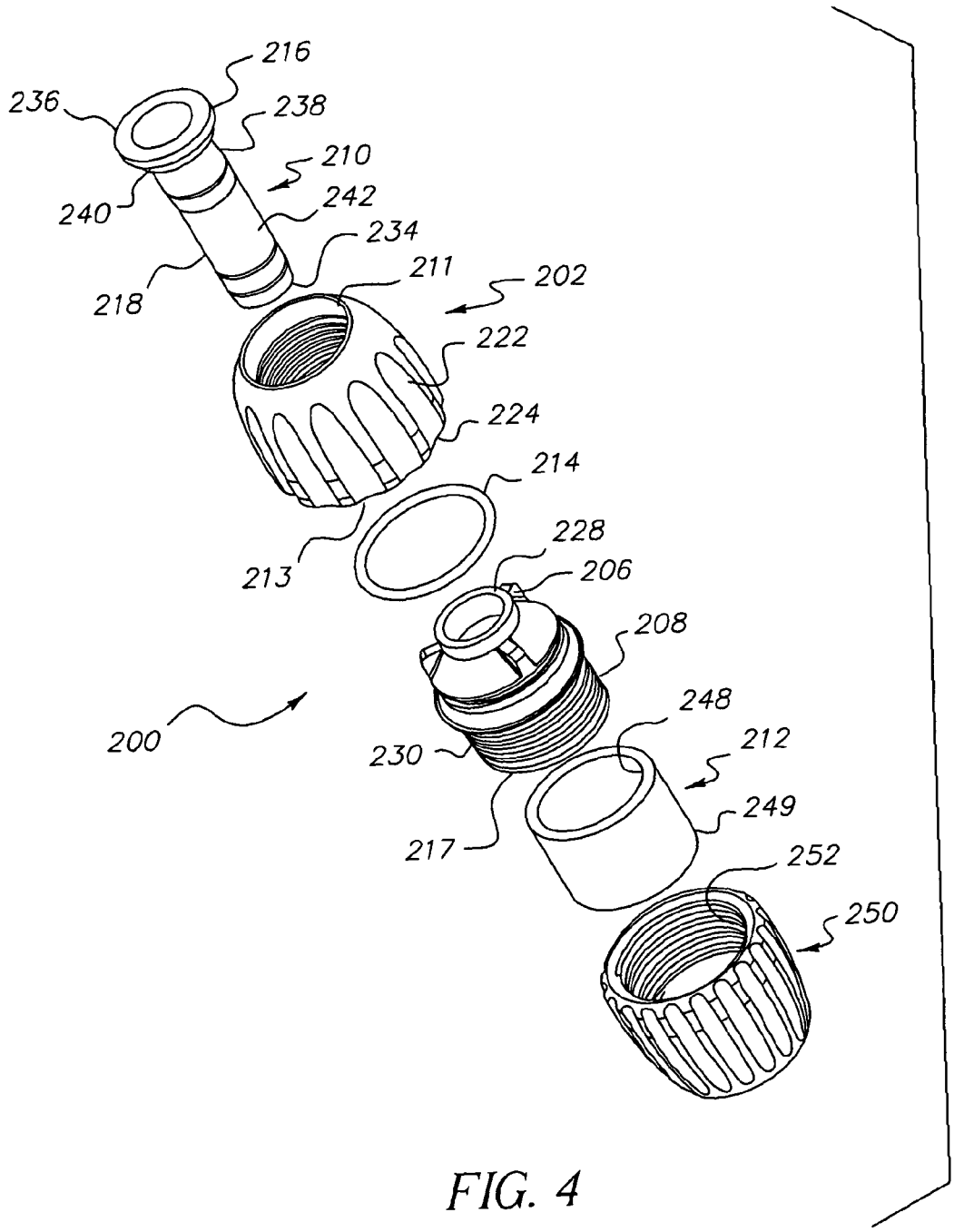
FIG. 4. is an exploded perspective view illustrating elements of a second embodiment of the Coax connector clutching mechanism of the present invention.

The collar member 212, as illustrated in FIG. 4, has a substantially cylindrical body and an annular bore 248 throughout its axial length. The annular bore 248 is adapted to receive a coaxial cable (not shown), and the outer surface 249 of the substantial cylindrical body is adapted to fit within the inner cavity of the connector body 208.

Figure 6:
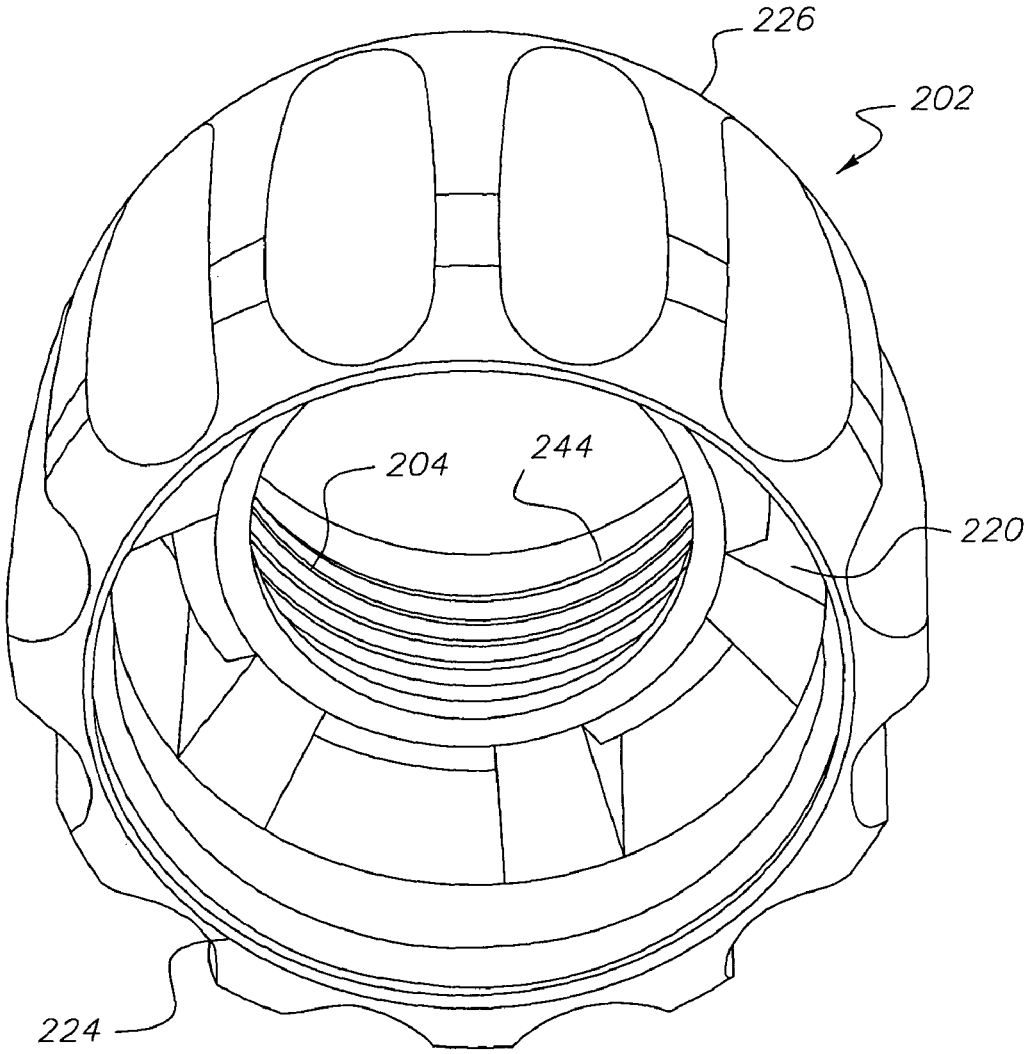
FIG. 6. is a perspective view illustrating the nut body of the second embodiment of the Coax connector clutching mechanism of the present invention.

Referring to FIG. 6, the nut body 202 includes a first end 226 and a second end 224, wherein inner surface of the first end comprises a threaded segment 204. The threaded segment 204 is adapted to be received by an externally threaded connector (not shown). Furthermore, the first end 226 is adapted to receive the post member 210, thereby permitting the post member 210 to rotate freely within said nut body 202. The nut body 202 further comprises an annular lip 244 adjacent to the threaded section 204 which shall communicate with the flanged end 236 of the base 216 of the post member 210 inserted within the nut body 202. As illustrated, the inner surface of the nut body 202 includes at least one internal clutch face 220 which will be discussed in greater detail in the following paragraphs.

Figure 7:
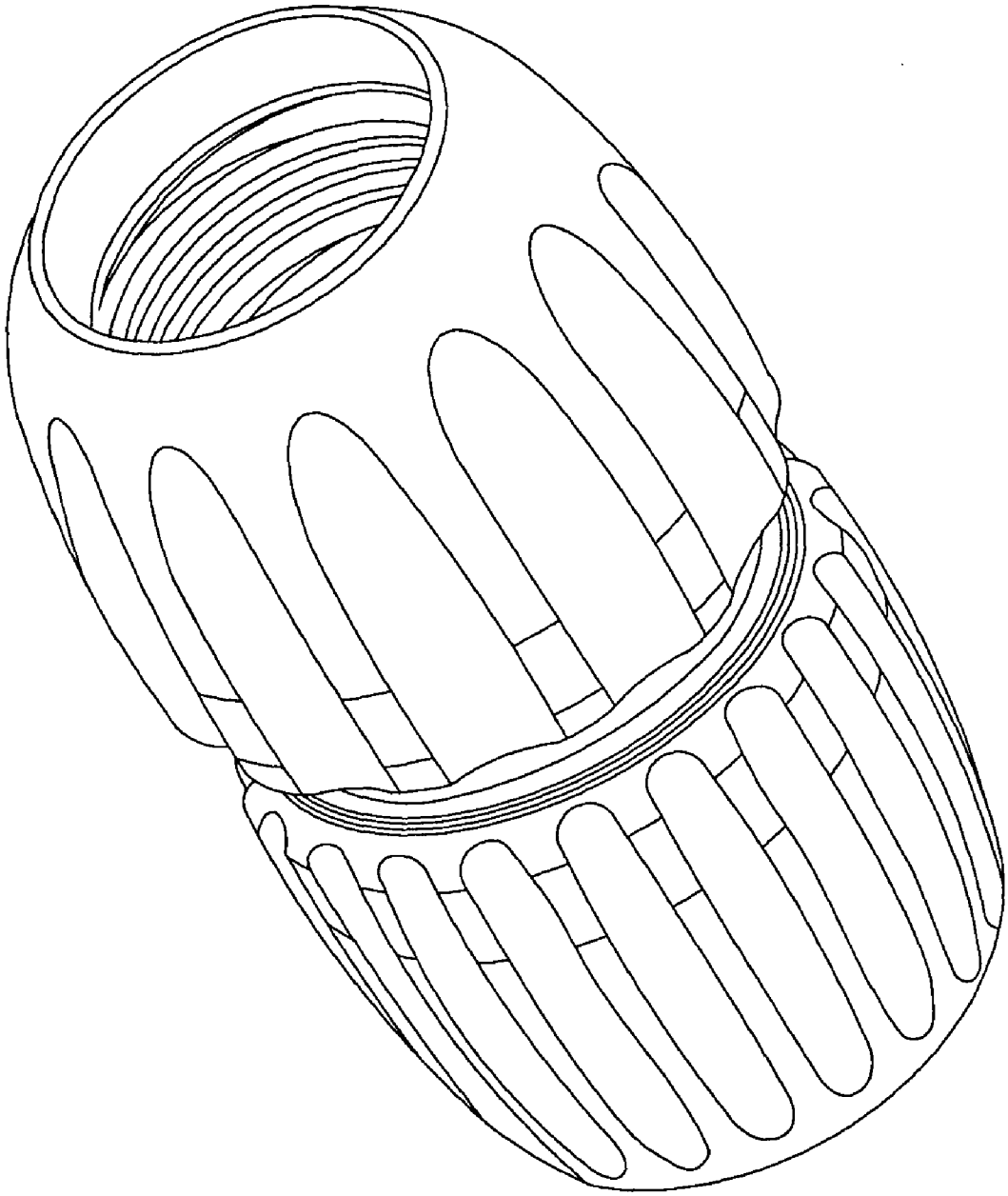
FIG. 7. is a perspective view illustrating the nut body in communication with connector body and end nut of the second embodiment of the Coax connector clutching mechanism of the present invention.

Referring again to FIG. 4 and for the first time to FIG. 7, the device is assembled by feeding the post member 210 through the first opening 211 in the nut body 202 as described above. O-ring 214 and connector body 208 are then inserted into the cavity 213 at the second end 215 of the nut body 202. The collar member 212 is adapted to be received within the cavity 217 of the connector body 208. With the aforementioned components in place, the threaded segment 252 of end nut 250 is advanced upon the threaded segment 230 of the connector body 208.

In operation, the clutch face 220 of the nut body 202 mates with a similar clutch face 206 of the connector body 208. The nut body 202 serves two functions. Upon installing the cable (not shown) on the connector body 208, the installer may hold the nut body 202 firmly with one hand, and push the cable in at the other end 229 of the end nut 250. The opposing forces of the cable being pushed and the installer's hand firmly holding the nut body 202, cause the clutch faces 206 and 220 to mechanically engage in a lock position (not shown). While the nut body 202 and connector body 208 are in the locked position, the installer may alternately rotate the prepared cable (not shown) clockwise and counter clockwise, thereby properly seating the cable in the connector body 208. With the cable seated in the connector body 208, the threaded segment of the end nut 250 may now be advanced forward onto the threaded segment of the connector body 230, thereby securing the cable to the connector 200. A view of the end nut 250 threadedly attached to the nut body 202 and connector body 208 of the present invention is illustrated in FIG. 7.

With the connector assemble 200 fully assembled, the installer may move the nut body 202 away from the connector body 208, thereby disengaging the clutch faces 206 and 220, to rotatably attach the nut body 202 to the interface port (not shown) without turning the cable.

Figure 8:
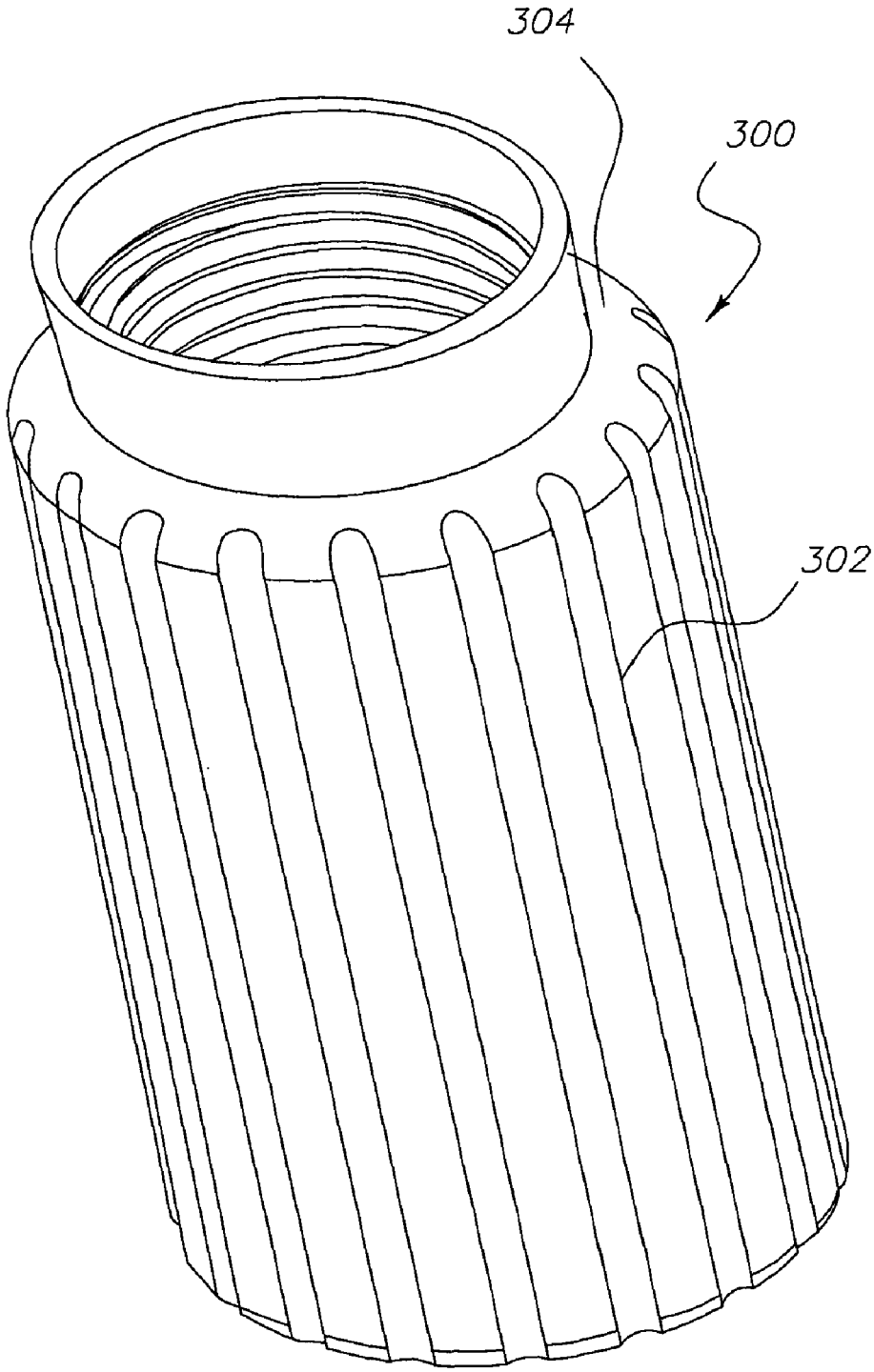
FIGS. 8 and 9 are perspective views illustrating nut bodies of additional embodiments of the Coax connector clutching mechanism of the present invention.
Figure 9:
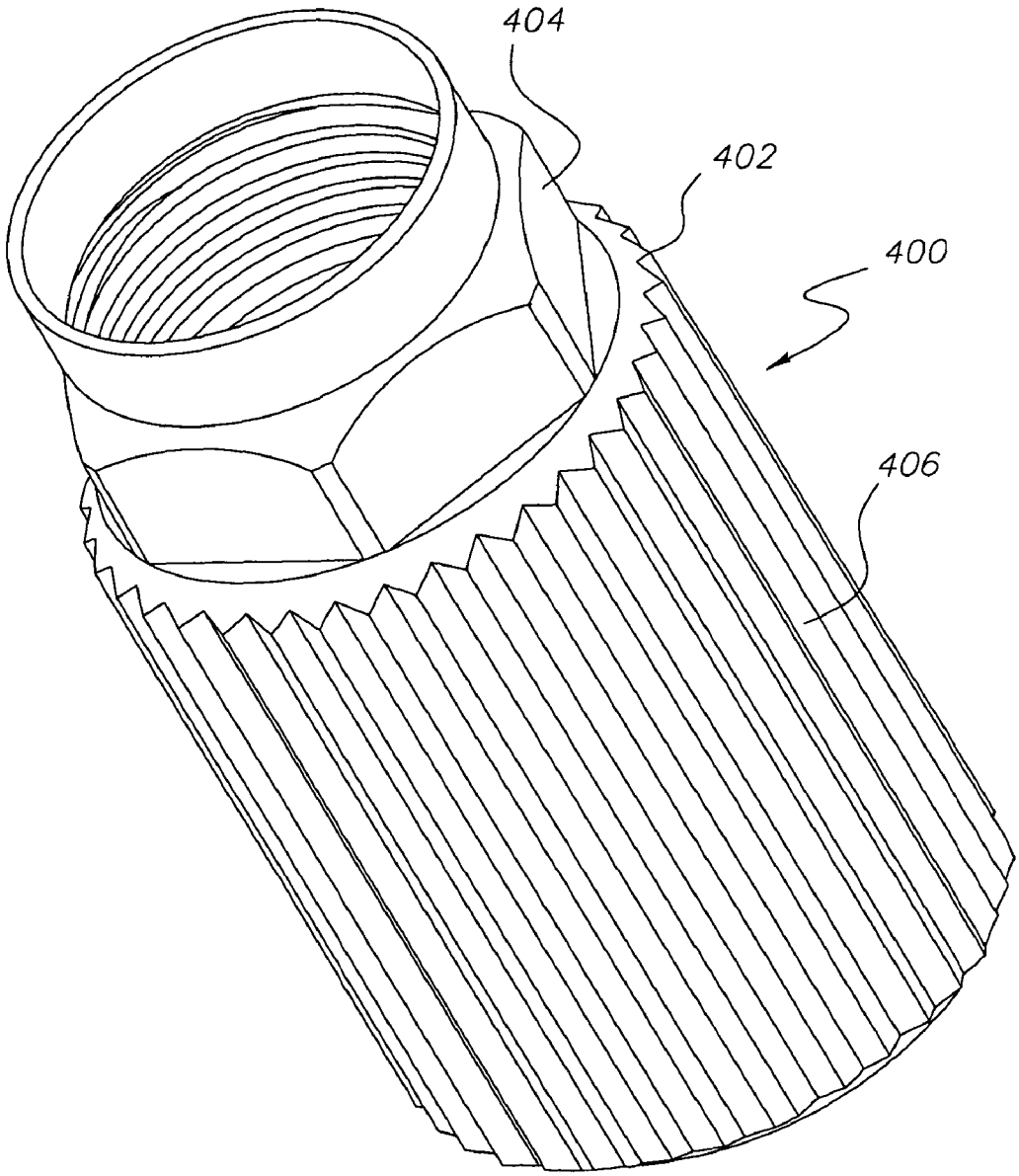

Referring now to FIGS. 8 and 9, perspective views illustrating nut bodies of additional embodiments of the coax connector clutching mechanism of the present invention are shown. FIG. 8 illustrates an elongated nut body 300 having a plurality of longitudinal grooves 302 on the outer surface 304. FIG. 9 illustrates a further embodiment of a nut body 400 of the present invention wherein the outer surface 402 comprises a hexagonal gripping means 404 and a plurality of grooves 406 running along the outer surface.

While this invention has been described as having particular embodiments, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

We claim:

1. A coaxial cable connector having an interlocking mechanism to permit securement of a coaxial cable end, said connector comprising:

a nut having an internal cavity, said internal cavity having defined therein a first mating face disposed on an annular inner flange; and, a connector body having at one end defined thereon a second mating face disposed on the distal end of said connector body, said first mating face and said second mating face defining complementary interlocking portions to facilitate the securement of a coaxial cable;

said connector body being axially movable in relation to said nut to cause the second mating face to engage the first mating face in a locked position, thereby creating an interlocking relationship between said nut and said connector body in which independent rotation of said connector body relative to said nut is restricted, and in which the first mating face and the second mating face are axially disengageable to a free position, enabling independent rotation of said nut following securement of said coaxial cable.

2. The coax connector of claim 1, further comprising a compression sleeve to secure said connector body in relation to said cable.

3. The coax connector of claim 1, wherein said nut further comprises an outer surface having a plurality of grooves thereby providing an external gripping surface.

4. A connector assembly for connecting a cable to an externally threaded port, said connector assembly comprising:

a nut having a first end and a second end, wherein said first end comprises a internally threaded component and is adapted to receive an externally mounted port, and said second end receives a portion of a connector body within an internal cavity;

a post having a first end and a second end;

said connector body having an internal cavity adapted to receive said post through a first end, and a second end that receives a prepared coaxial cable end;

means for interlocking said nut relative to said connector body said means being engaged in a locked position by axially moving the nut toward the connector body wherein complementary interlocking features provided within the elongated nut and the first end of the connector body are axially joined, thereby preventing independent rotation of said connector body while permitting said prepared coaxial cable end to be attached to said post through said connector body in said locked position through two-handed user engagement of said nut and said cable, respectively, and said means being disengaged to a free position by axially moving the nut away from the connector body, thereby permitting independent rotation of said nut to permit securement of said nut to an externally mounted port in said free position wherein said means comprises a first face disposed on an inner annular flange of said nut, and a second face disposed on the first end of said connector body; and, a crimping means for securing said cable to said connector body.

5. The assembly of claim 4, wherein said nut further comprises an outer surface having a gripping means for allowing an installer to firmly grip the elongated body.

6. The assembly of claim 5, wherein said gripping means comprises a plurality of longitudinal grooves distributed along the outer surface of the nut.

7. The assembly of claim 4, wherein said crimping means for securing said cable to said connector body comprises a compression sleeve adapted to engage the outer surface of said connector body and said cable to thereby secure said cable within said connector body.

8. The assembly of claim 7, wherein said compression sleeve comprises an internal bore having a substantially flanged end terminating at an annular lip, and said outer surface of said connector body has a substantially annular groove, wherein advancing said compression sleeve upon said connector body serves to place said annular lip of said compression sleeve in locking engagement with said annular groove of said connector body.

9. A method of attaching a coax cable to a connector wherein said connector comprises a post, an extended nut, a connector body, and a compression sleeve, said extended nut including an internal cavity including an annular inner flange, said method comprising the steps of:

axially pushing the extended nut towards the connector body, thereby causing a first set of features of an inner cavity of the connector body to engage a second set of complementary features provided on the annular inner flange of the extended nut so as to create interlocking engagement therebetween, thereby defining a locked position and preventing rotation of the nut relative to the connector body in said locked position;

inserting a prepared end of the coaxial cable into the connector body until seated in relation to the post while said connector is in said locked position using two hands by holding the nut in one hand and the cable end in the remaining hand;

advancing the compression sleeve toward the connector body thereby securing the cable to the connector while in said locked position; and axially disengaging the connector body from the extended nut after said advancing step to allow the extended nut to rotate independently from the connector body and cable.

10. The method of claim 9, wherein said extended nut further comprises an internal threaded segment and said cable and connector are connected to a port by advancing said internal threaded segment of said extended nut upon a threaded segment of a port.

11. The method of claim 9, wherein the nut is free to rotate with respect to the connector body when said nut and connector body are in an unlocked position when the nut is axially moved away from the connector body, thereby disengaging the first and second set of complementary interlocking features.

12. A coax connector having an operatively interlocking mechanism, said interlocking mechanism comprising:

a nut having at least one first interlocking surface disposed on an inner annular flange; and a connector body having at least one second interlocking surface disposed at a distal end;

whereby the first and second interlocking surfaces engage by axially moving one of nut and the connector body toward each other thereby preventing independent rotation of said connector body to permit attachment of a prepared coaxial cable end to said connector; and the first and second interlocking surfaces disengage by axially moving one of the nut and the connector body away from each other following attachment of said cable end, and in which said nut is rotatable when said first and second interlocking surfaces are disengaged.

* * * * *